US005622604A

United States Patent [19]

Gerstenkorn et al.

[11] Patent Number: 5,622,604

[45] Date of Patent: Apr. 22, 1997

[54] COKE COOLING APPARATUS

[75] Inventors: Ralph Gerstenkorn; Leslie J. Okonek, both of Bellingham, Wash.

[73] Assignee: Atlantic Richfield Company, Los Angeles, Calif.

[21] Appl. No.: 395,057

[22] Filed: Feb. 27, 1995

[51] Int. Cl.[6] ..... C10B 39/10

[52] U.S. Cl. ..... 202/227; 202/229; 202/230; 201/39; 165/90

[58] Field of Search ..... 202/227, 229, 202/230; 201/39; 165/88, 90

[56] References Cited

U.S. PATENT DOCUMENTS

| | | | |
|---|---|---|---|
| 2,840,922 | 7/1958 | Erisman et al. | 202/227 |
| 2,884,229 | 4/1959 | Francis et al. | 165/90 |
| 2,899,176 | 8/1959 | Francis et al. | 202/227 |
| 3,917,516 | 11/1975 | Waldmann et al. | 202/227 |
| 4,557,804 | 12/1985 | Baumgartner et al. | 202/227 |
| 4,565,452 | 1/1986 | Wild | 366/149 |
| 4,588,429 | 5/1986 | Hohman et al. | 65/27 |
| 4,667,731 | 5/1987 | Baumgartner et al. | 165/88 |
| 4,711,297 | 12/1987 | Haacker et al. | 165/88 |
| 4,747,913 | 5/1988 | Gerstenkorn et al. | 202/227 |
| 5,440,823 | 8/1995 | Willgohs | 34/363 |

FOREIGN PATENT DOCUMENTS

| | | |
|---|---|---|
| 956543 | 9/1982 | U.S.S.R. . |
| 2195424 | 4/1988 | United Kingdom . |

*Primary Examiner*—Nina Bhat
*Attorney, Agent, or Firm*—Michael E. Martin

[57] ABSTRACT

A rotary coke cooling drum is formed of plural opposed folded plates welded together and having spaced apart openings for receiving an array of tubular cooling pockets which are separately formed and are insertable in the openings to provide heat transfer surfaces and auger flights for traversing material through the drum. The cooling pockets are formed by opposed trapezoidal shaped plate members which are welded to each other along mating edges leaving one end of the cooling pocket substantially open and the opposite end is closed over a major portion by an end cap and a short section of drain conduit adapted to project through the wall of the drum shell. The cooling pockets may each have a locating and mounting flange or doubler plate secured at the open end of the pockets and adapted to be welded to the wall of the drum shell. The pockets are easily inserted in and removed from the drum shell for repair or replacement as needed.

16 Claims, 4 Drawing Sheets

COKE COOLING APPARATUS

FIELD OF THE INVENTION

The present invention pertains to a rotary coke cooling drum including an improved drum shell and heat exchange cooling pocket configuration.

BACKGROUND

Petroleum coke and certain similar granular materials are processed by passing the material in a heated state through a cooling apparatus characterized by a generally horizontally disposed rotating heat exchanger drum which is particularly configured to rotate in a water bath while the granular material is progressively passed through the interior of the drum from one end to the other to uniformly reduce the material temperature. Petroleum coke cooling apparatus, in particular, is subjected to substantial mechanical, chemical and thermal degradation of the rotary drum assembly. The granular coke material can be particularly abrasive. Moreover, gases generated by the coke together with water vapor which condenses on the drum interior can form acids particularly corrosive to steel and similar metal surfaces of the drum. Still further, thermally induced stresses accelerate the wear and tear on the drum shell and the heat exchange surfaces.

The economical production of petroleum coke requires that cooling drum assemblies be of substantial size in order to handle the volume of material to be processed. Typically, a coke cooling drum may be on the order of thirty feet in length and ten to twelve feet in diameter. A well accepted design of coke cooling drums provides for a plurality of axially and circumferentially-spaced pocket-like members formed in the drum wall which provide heat transfer surfaces for cooling the coke. At least the pockets at the inlet end of the drum are also arranged to form a somewhat helical pattern so that, upon rotation of the drum, the pockets act as auger flights to progressively move the granular coke material to minimize flooding the drum at an inlet opening disposed at one end of the drum.

The corrosive and abrasive action of the coke material together with the thermally induced stresses acting on the drum during operation can shorten the life of at least certain parts of the drum, particularly, the members forming the aforementioned cooling pockets. Accordingly, it is particularly desirable to be able to easily repair or replace the cooling pocket members without replacing a major portion of the cooling drum or without even removing the cooling drum from its working position. Moreover, there has been a continuing desire to improve the cooling efficiency and overall operating effectiveness of rotary type coke cooling drums of the type which rotate in a bath of cooling liquid, such as water. It is to these ends that the present invention has been developed.

U.S. Pat. No. 2,899,176 to Francis et al.; U.S. Pat. No. 3,917,516 to Waldmann et al.; U.S. Pat. Nos. 4,557,804; 4,667,731 to Baumgartner et al. and U.S. Pat. No. 4,747,913 to Gerstenkorn et al. (the last mentioned patent being assigned to the assignee of the present invention) describe various features of prior art coke cooling drums. The U.S. Pat. No. '176 patent to Francis et al. describes a coke cooling drum having circular segment-shaped pockets which are made up of plural welded plate members which are secured to the inside of the drum shell. The U.S. Pat. No. '516 patent to Waldmann et al. describes a coke cooling drum having generally tubular-shaped cooling pockets extending transversely therewithin and provided with abrasion or wear resistant weld metal or angle plates secured to the cooling pocket surfaces which are usually subject to severe wear. The patents to Baumgartner et al. also describe coke cooling drum water cooling pockets which are provided with wear-resistant material and the cooling pockets may be formed of a folded metal shell which may be inserted in an opening in the drum shell and welded in place. The U.S. Pat. No. '913 patent to Gerstenkorn et al. describes coke cooling drum pockets which are formed of clad plate members which are welded together to form the pocket itself. The cooling drum shell is cylindrical and has large peripheral openings for receiving the cooling pockets.

The cooling pocket members described in the prior patents identified above are not easily fabricated and are not easily inserted in and removed from the drum shell itself if it is desired to replace or repair one or more of the pockets. Moreover, the configurations of the drum shells and the cooling pockets provide for excessively large openings to be cut in the cooling drum shell which tends to weaken the drum shell thereby requiring the elongated tie rod arrangement described in the Gerstenkorn et al. patent, for example.

SUMMARY OF THE INVENTION

The present invention provides an improved coke cooling apparatus, including a rotatable coke cooling drum, having an improved cooling pocket arrangement and improved drum shell construction for receiving the cooling pockets.

In accordance with an important aspect of the present invention, a coke cooling drum is provided with plural cooling pockets which are constructed in such a way that the pockets are easily constructed, and are easily inserted in a drum shell and removed therefrom when repair or replacement of one or more of the pockets is necessary.

In accordance with another important aspect of the invention, a coke cooling apparatus is provided with a cooling drum having plural cooling pockets for receiving coolant such as water, which cooling pockets are of unique construction, are easily fabricated of a minimum number of parts, and are particularly adapted to be easily inserted in and removed from the drum. The cooling pockets are preferably formed of opposed plate members which are folded and welded together to form a generally oblong tubular pocket assembly. One end of the pocket is substantially closed by a cover plate and a coolant drain pipe and the other end of the pocket is provided with a locating flange or doubler plate for locating the pocket in the cooling drum and for securing the pocket to the cooling drum.

In accordance with yet a further aspect of the present invention, a coke cooling drum is provided with plural cooling pockets which are more easily formed of hard faced or corrosion resistant cladding whereby the pockets may be constructed of economical materials but are provided with a suitable wear and corrosion resistant surface exposed to the hot and corrosive coke material during operation of the cooling drum.

Still further in accordance with the invention, a coke cooling drum is provided wherein the rotor or drum shell is of improved construction wherein openings are provided for receiving the separately fabricated cooling pockets in such a way that the strength and rigidity of the shell is not significantly reduced due to the formation of the cooling pocket openings.

The improved cooling drum and pocket arrangement of the invention provides for simplified assembly of the cooling drum during initial construction, permits use of hard face and corrosion resistant clad metals which are more easily worked in fabricating the cooling pockets, and also provides for easier repair or replacement of cooling pockets which have become worn or damaged during use of the drum. Still further, the cooling pocket arrangement provides easier modification of the pockets to receive and discharge coolant during operation of the drum. The construction of the cooling pockets themselves is such that a reduced amount of metal working and welding is required for constructing the pockets and the size of a coolant drain orifice or opening is easily modified, if desired.

Those skilled in the art will recognize the above-mentioned features and advantages of the invention together with other superior aspects thereof upon reading the detailed description which follows in conjunction with the drawing.

DESCRIPTION OF A PREFERRED EMBODIMENT

Figure 1:
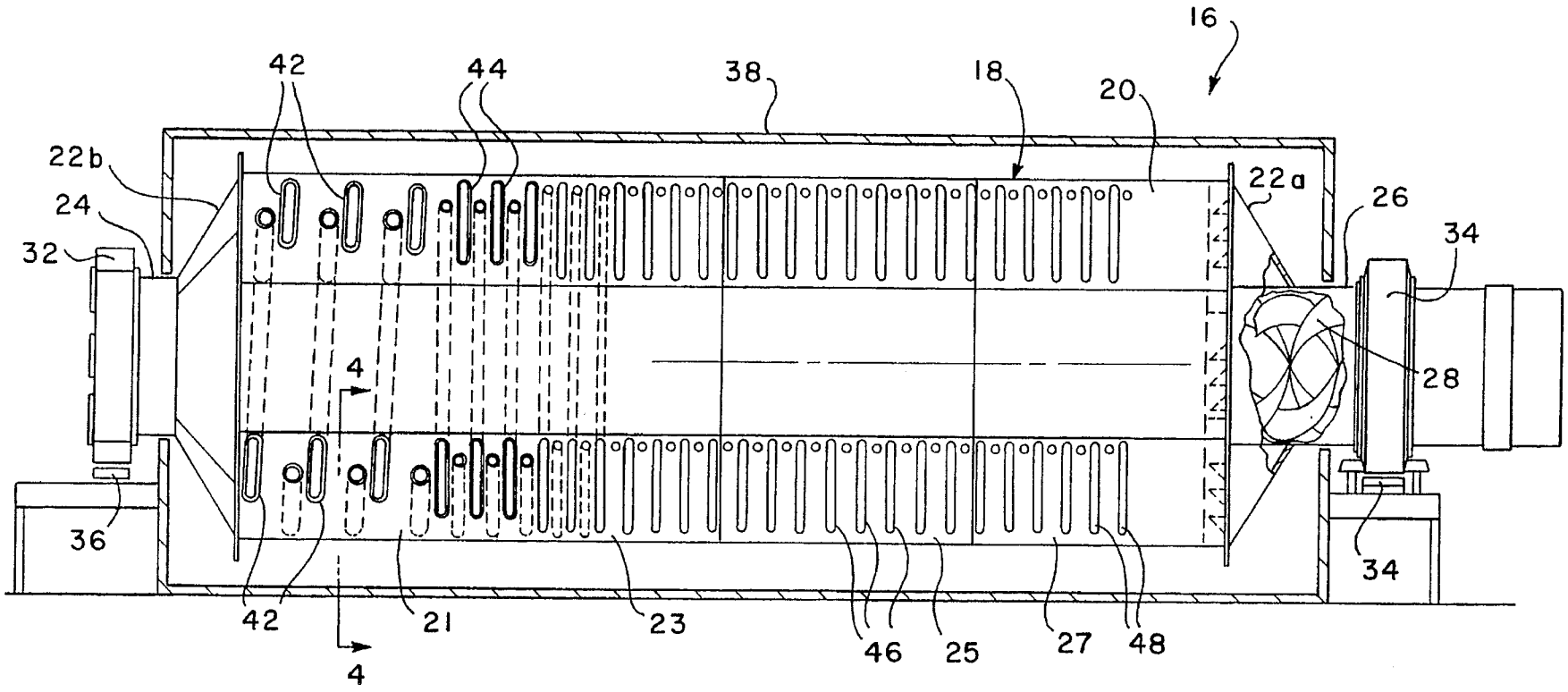
FIG. 1 is a side elevation, partially sectioned, of a coke cooling apparatus in accordance with the invention.

In the description which follows like parts are marked throughout the specification and drawing with the same reference numerals, respectively. The drawing figures are not necessarily to scale in the interest of clarity and conciseness.

Figure 2:
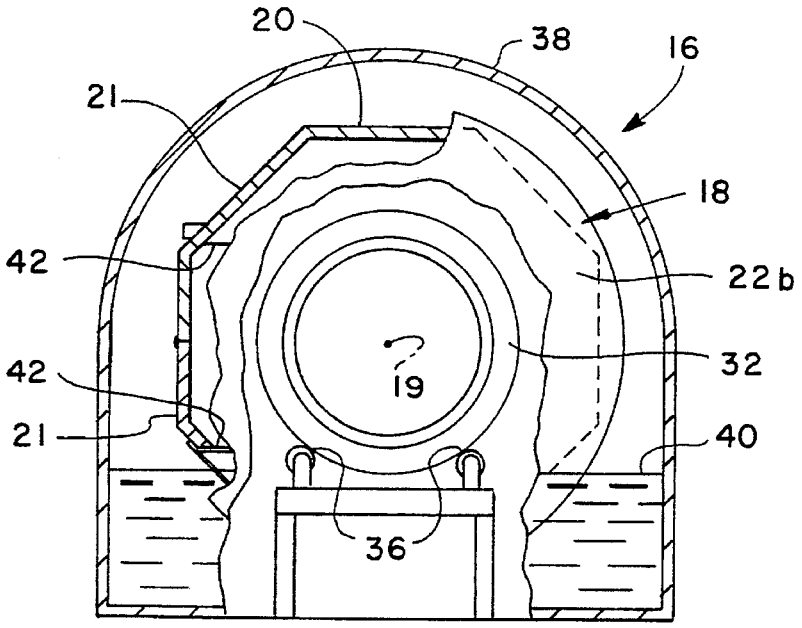
FIG. 2 is an end view, partially sectioned, of the apparatus shown in FIG. 1.

Referring to FIGS. 1 and 2, there is illustrated an improved coke cooling apparatus in accordance with the invention and generally designated by the numeral 16. The apparatus 16 includes a unique coke cooling drum 18 comprising an elongated drum shell 20 of generally octagonal cross sectional configuration, and having opposed frustoconical end caps 22*a* and 22*b*. An inlet end duct 24 is connected to the cap or head 22*b* for receiving hot coke material or the like, not shown, from a suitable inlet chute, also not shown. The drum 18 is also provided with a generally cylindrical discharge duct 26 having suitable auger flights 28 formed therein for discharging cooled, generally granular coke material therefrom to a suitable transport conveyor, not shown. The drum 18 is mounted for rotation about a central longitudinal axis 19 on suitable spaced-apart tires 30 and 32 which are supported on support roller assemblies 34 and 36, respectively.

The drum shell 20 is disposed in a water bath enclosure 38 which may contain a suitable coolant spray nozzle array, not shown, for discharging cooling water onto the surface of the drum 18. As shown in FIG. 2, the enclosure 38 is also operable to maintain a cooling water bath 40 therein wherein the drum 18 is immersed partially in the cooling water bath and at least some of the cooling water in the bath 40 is picked up and held at least momentarily by a plurality of axially and circumferentially spaced-apart cooling pockets supported on the shell 20. As shown in FIGS. 1 and 2, a first course of cooling pockets 42 is arranged in a generally helical pattern circumferentially and axially spaced in such a way that the pockets also act as auger flights to transport coke material through the interior of the shell 20 from the inlet duct 24 to the discharge duct 26 during rotation of the drum 18. Successive courses of axially and circumferentially spaced pockets 44, 46 and 48 are formed in the drum shell 20 in substantially the same manner as the pockets 42. However, the pockets 44, 46 and 48 may not necessarily be arranged in a helical pattern but are circumferentially and axially spaced from each other in such a way that the coke material moves progressively through the drum shell 20 from the inlet duct 24 to the discharge duct 26. As previously mentioned, each of the cooling pockets 42, 44, 46 and 48 is operable to receive cooling water from the bath 40, for example, and forms heat transfer surfaces for effecting cooling of the coke or other somewhat similar material within the drum shell 20 as it progresses therethrough.

For sake of further discussion herein, the portion of the drum shell 20 which receives the cooling pockets 42 will be described in some detail as will the cooling pockets 42. The cooling pockets 44, 46 and 48 as well as the components of the drum shell 20 which support these pockets are of similar construction. The primary difference between the portion of the drum shell 20 which supports the pockets 42 and the remainder of the cooling drum 18 is that the pockets 44, 46 and 48 are of somewhat narrower and deeper configuration to maximize the heat transfer surfaces formed thereby. Otherwise, the construction of the shell plates which support the pockets 44, 46 and 48 and the general construction of these cooling pockets is essentially the same as will be described for the pockets 42.

Figure 3:
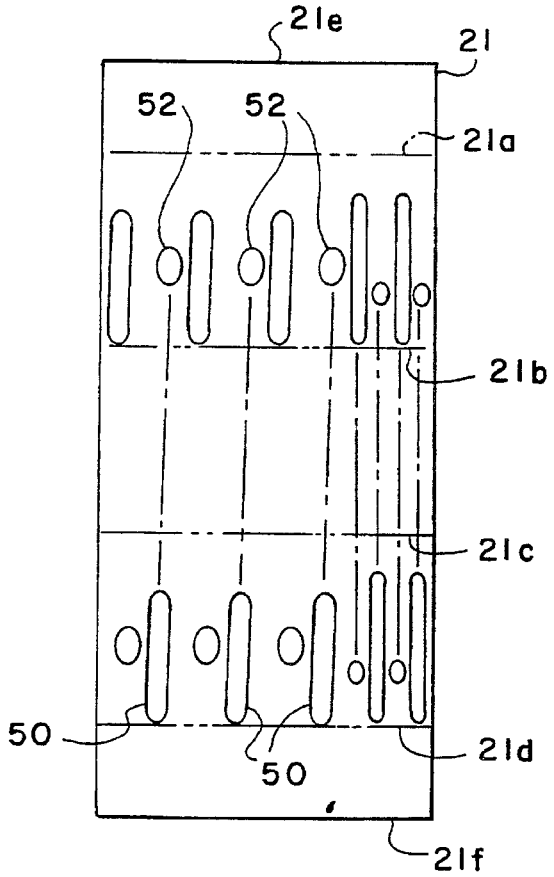
FIG. 3 is a developed plan view of a typical plate member used in making up the rotor or drum shell.

Referring further to FIGS. 1 and 2 and also FIG. 3, the drum 18 is made up of opposed pairs of folded metal plates 21, 23, 25 and 27 which are suitably welded together to form the octagonal drum shell 20. One of the plates 21 is shown in a developed plan view in FIG. 3. Each of the plates 21, 23, 25 and 27 is preferably folded into a shape to create one-half of the octagonal cross sectional configuration of the drum 18 by bending each plate along bend lines 21*a*, 21*b*, 21*c* and 21*d*, for example. Opposed plates 21 are then welded together along their opposed parallel side edges 21*e* and 21*f* to form a first course of the shell 20. Opposed sets of plates 23, 25 and 27 are similarly folded and welded together to form the successive courses of the shell 20 and each course is welded to its adjacent course along the longitudinal side edges of the respective sets of plates to form the octagonal shell configuration.

Prior to bending the plates 21, 23, 25 and 27, suitable openings are formed in each plate to provide for receiving the unique cooling pockets 42, 44, 46 and 48, respectively. As shown in FIG. 3, by way of example, each plate 21 is formed to have respective elongated openings 50 formed therein and suitably aligned smaller openings 52 aligned with each one of the openings 50 in a somewhat helical or skewed pattern as illustrated. As shown in FIG. 3, the openings 50 and 52 are formed on opposite sides of the bend lines 21*b* and 21*c* so that the segment of the plate 21 between the lines 21*b* and 21*c* is not weakened by any openings therein. In like manner, the segments of the plate 21 formed between the lines 21*a* and the edge 21*e* and between the line 21*d* and the edge 21*f*, respectively, are also not cut or broken by any opening formed therein. In this way when the plates 21, 23, 25 and 27 are welded together to form the drum 18 the drum has a greater degree of rigidity than prior art drums which have large cooling pocket receiving openings which intersect a substantial part of the circumference of the drum shell. Accordingly, the drum shell 20 has greater stiffness than certain prior art shells which have substantial cut-out portions of the shell wall for receiving separate cooling pocket components. Moreover, coke cooling drums, such as the drum 18, are subject to significant abrasive action and corrosion as the coke cools progressively when moving through the drum from the inlet duct to the discharge duct.

The drum 18 may be constructed of plates of carbon steel for the plates 21 and 23 over the first half of the drum from the inlet end. The drum 18 is preferably constructed of stainless steel clad steel plates for the plates 25 and 27 of the portion of the drum from the longitudinal center to the discharge duct 26. It is over the downstream half portion of the drum 18 that the coke has cooled enough to become an abrasive granular material and wherein corrosive action from the outgassing of sulfur dioxide which has condensed with water vapor to form sulfurous acid attacks the interior surfaces of the drum. All or only some of the cooling pockets 42, 44, 46 and 48 may also be made of a clad steel material. Preferably, the pockets occupying the shell courses formed by the plates 25 and 27 will be formed of stainless steel clad carbon steel material, although the pockets 42 and 44 may also be formed of clad steel, if desired.

Figure 4:
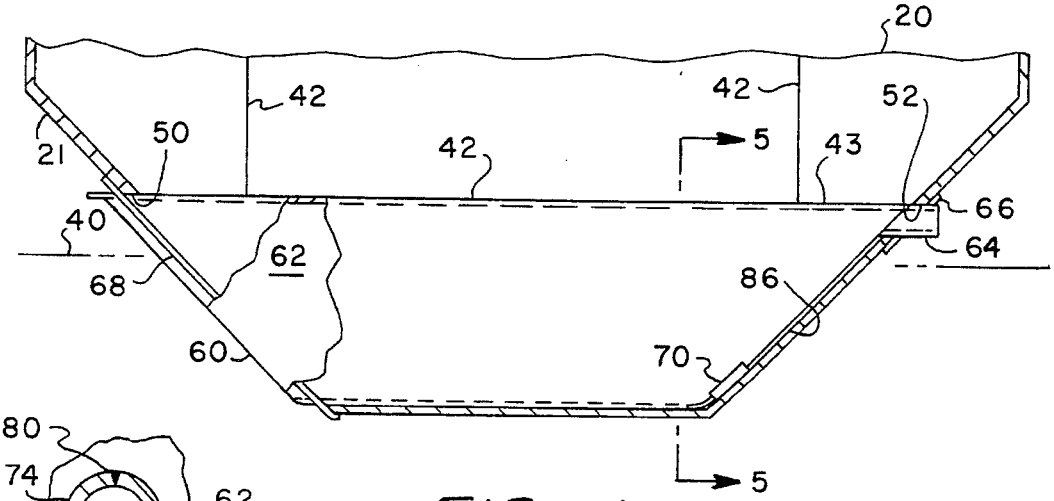
FIG. 4 is a section view taken generally along the line 4—4 of FIG. 1.
Figure 6:
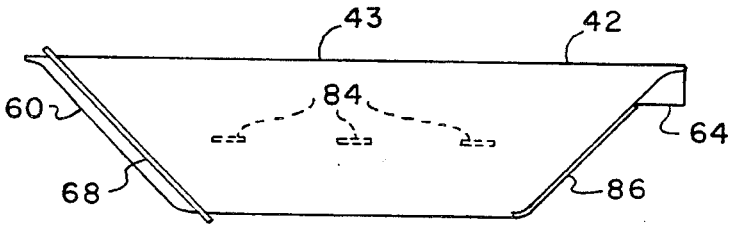
FIG. 6 is a side elevation of a typical cooling pocket in accordance with the invention.
Figure 7:
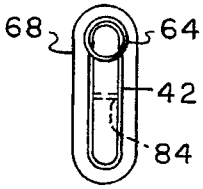
FIG. 7 is a right end view of the cooling pocket shown in FIG. 6.

Referring now to FIGS. 4, 6 and 7, there is illustrated one of the pockets 42 shown in longitudinal side elevation in both FIGS. 4 and 6 and in an end view in FIG. 7. In FIG. 4, a pocket 42 is shown disposed in the drum 18 and secured therein in a unique manner. The pocket 42 is a somewhat trapezoidal shaped tubular body forming a conduit having an open end 60 for receiving cooling water within an interior space 62 formed by the pocket as the drum rotates in a clockwise direction, viewing FIGS. 2 and 4. Cooling water collected within the space 62, as a pocket 42 rotates through the bath 40, is allowed to drain out of the space 62 through a suitable drain conduit or pipe 64 formed in the opposite end of the pocket from the opening 60. The drain pipe 64 may be of a suitable size to meter the flow of cooling water out of the space 62 as the pocket 42 rotates through and out of the coolant bath 40. FIGS. 2 and 4 illustrate a typical level of the coolant bath 40 as the pockets 42 rotate therethrough. By placing the coolant drain pipe 64 at the so-called upper edge 43 of the pocket 42, when in the position shown in FIG. 4, cooling water flows into the space 62 with ease since the drainpipe 64 forms a vent for venting air and water vapor from the space 62.

Figure 5:
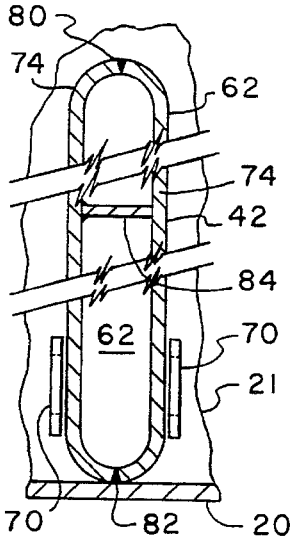
FIG. 5 is a detail section view taken from the line 5—5 of FIG. 4.

As shown in FIGS. 4 and 5, the cooling pockets 42 are disposed snugly fitted adjacent the inside wall of the shell 20 formed by the plates 21 and are each at least partially supported in their working position by a generally elliptically shaped flange 66 disposed around the drainpipe 64. A somewhat elongated or oval-shaped flange 68, sometimes known as a doubler plate, see FIGS. 6 and 7 also, is disposed around the opening 60 at the opposite end of the pocket 42 and is suitably welded to the pocket sidewalls. Moreover, the pockets 42, as well as the other pockets described hereinabove, are each also secured in their working position by spaced apart locating plates 70, see FIGS. 4 and 5, which are suitably welded to the inside surface of the shell plates 21, for example, as shown. Each of the aforementioned pockets 44, 46 and 48 may be suitably secured by a pair of spaced apart locating plates, not shown, in the same manner as illustrated for the pocket 42 in FIGS. 4 and 5.

Figure 8:
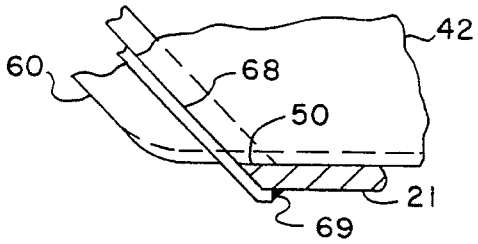
FIG. 8 is a detail view showing an improved method of attachment of the cooling pocket to the rotor or drum shell.

Those skilled in the art will appreciate that the construction of the pockets 42 as well as the other pockets described above, and the construction of the drum shell 20, is such that each of the pockets may be easily inserted into the shell and secured in its working position. For example, each pocket 42, which is preferably separately fabricated, may be inserted into the drum shell 20 through the opening 50 and secured in its working position by welding the flange or doubler plate 68 around its periphery to the outside surface of plate 21. FIG. 8 shows a detail view wherein the flange or doubler plate 68 is welded at 69 to the plate 21. This weld may be a circumferential weld around the periphery of the doubler plate 68. Once the pocket 42 is in position with its drain pipe 64 projecting through the opening 52, see FIG. 9 also, the flange 66 is placed over the opening 52 and welded to the plate 21 and to the drain pipe 64 at welds 67 and 69, respectively, FIG. 9. Welding the flanges 66 and 68, as described, not only aids in rigidly securing the pocket 42 in its working position but also provides for easy removal of the pocket 42 from the drum shell 20 by merely cutting away the welds at the flanges 66 and 68 with a suitable metal cutting torch or the like, not shown.

Figure 9:
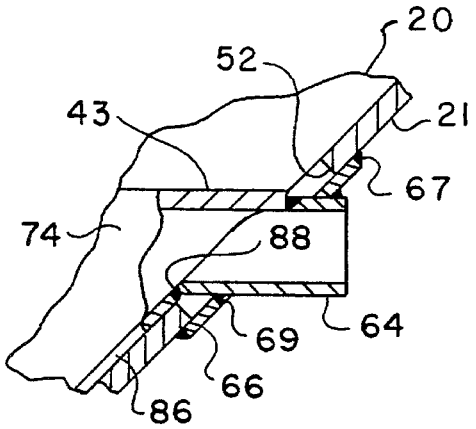
FIG. 9 is a detail section view showing another point of attachment of the cooling pocket to the drum shell.
Figure 10:
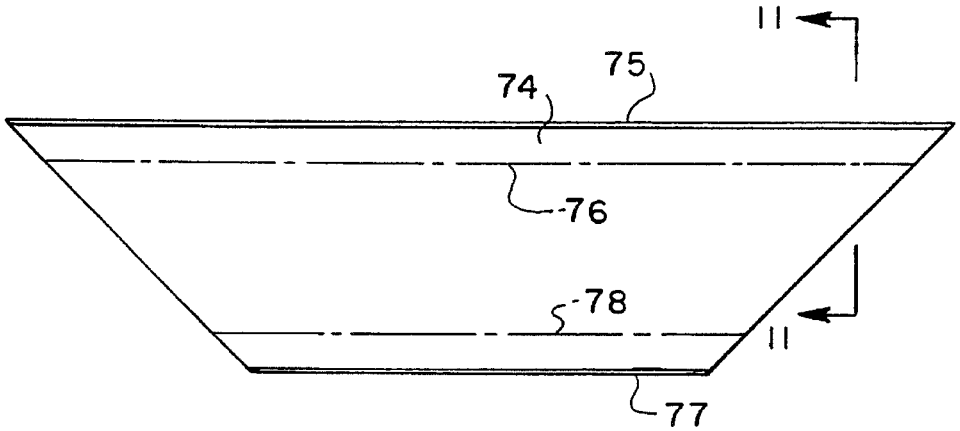
FIG. 10 is a developed plan view of one of the plates used in making a cooling pocket.
Figure 12:
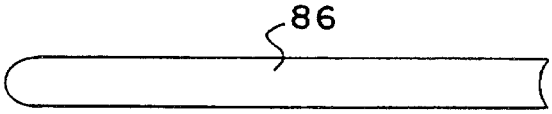
FIG. 12 is a detail plan view of an end plate for one of the cooling pockets.

Referring now to FIG. 10, each of the pockets 42 may be made up of a pair of opposed trapezoidal-shaped steel plates 74, one of which is shown in a planar development in FIG. 10. The plates 74 may be bent or folded along respective fold or tangent lines 76 and 78 and welded to each other at respective welds 80 and 82, FIG. 5, to form the elongated oval shaped tubular space 62 for holding cooling water during operation of the drum 18. Suitable spaced apart webs 84 may be interposed between and welded to the plates 74, FIGS. 5 and 6, to add rigidity to the pockets 42. The end of the pocket 42 opposite the end having the opening 60 is closed by a suitable pocket end cap 86, FIGS. 9 and 12, which is disposed adjacent the drain pipe 64 and is secured thereto and to the opposed plates 74, as shown in FIG. 9, by a suitable weld 88.

Figure 11:
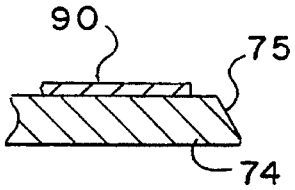
FIG. 11 is a detail section view taken from the line 11—11 of FIG. 10.

Accordingly, each of the pockets, including the pockets 42, may be formed of opposed trapezoidal-shaped plates which are folded along suitable fold lines to provide opposed somewhat oval or curved folds and welded together to form a hollow duct or tube-like configuration. One end of a pocket 42 may then be substantially closed by an end cap, such as the end cap 86, suitably welded along its peripheral edges to the opposed pocket plates 74. Finally, the drain pipe 64 and the flange 68 are welded to the pocket plates 74 to form a completed pocket assembly made up of a minimum number of parts which are easily fabricated. Moreover, each pocket, such as the pocket 42, may be easily inserted in the drum shell 20 and secured thereto by welding at the flanges 66 and 68, for example. FIG. 11 shows a detail view of how the opposed edges 75 and 77 of the plate 74 are suitably beveled to provide for welding the plates to each other. An overlay 90 of stainless steel or other abrasion and corrosion resistant material may be added to the plates 74, and particularly the plates making up the pockets 46 and 48.

Those skilled in the art will further appreciate that after somewhat extended use of the cooling apparatus 16, the pockets 42, 44, 46 and 48 may become worn or corroded to the extent that they begin to leak. If such occurs, any one of the pockets may be easily replaced without removing the drum 18 from its working position. Moreover, temporary repairs may be made to the aforementioned pockets by welding a closure, not shown, over the opening 60 and the open end of the drainpipe 64, for example, to close off particular ones of the pockets from receiving cooling water so that the leakage problem is at least temporarily solved. However, if a significant number of pockets are temporarily inactivated in this manner the cooling effect of the apparatus 16 may be reduced to the point where the pockets will need actual repair or replacement.

If the cooling capacity of the pockets 42, 44, 46 and 48 is in need of adjustment this may be carried out by modifying the diameter of the drainpipe 64 or by adding a flow restricting orifice to the discharge end thereof to control the rate of cooling water flow out of the spaces 62 during operation of the apparatus.

The fabrication of the apparatus 16, including the drum 18 and the cooling pockets 42, 44, 46 and 48, is believed to be within the purview of the artworker from the foregoing description. Briefly, however, the pockets 42, for example, may be constructed by cutting or otherwise forming plates 74 out of a suitable steel such as SA-516-70 carbon steel. The thickness of the plates 74 may be on the order of about 0.50 inches and for the cooling pockets in the downstream section of the drum 18 the plates may be provided of the above-mentioned type of steel with a stainless steel cladding, type 304L, having a thickness of about 0.125 inches, such as available from Lukens Steel. This cladding is, of course, on the surfaces of the plates which will be exposed to the interior of the drum shell 20 in contact with the coke material or a similar material being cooled by the drum 18.

After fabrication and folding of the plates 74, for example, they are welded together along the welds 80 and 82, FIG. 5, and the end cap 86 is then welded to the assembled plates. The strengthening webs 84 are suitably welded in place spaced apart between the plates 74 approximately mid-way between the top and bottom edges of the pockets, as shown in FIGS. 5 and 6. The drainpipe 64 may then be welded in position and the flange or doubler plate 68 may also be welded into its final assembled position so that a finished cooling pocket 42 is provided and is ready for assembly into the separately fabricated drum shell 20. Each pocket may be easily slid into its working position within the drum shell 20 through the associated large opening 50, for example, so that the drainpipe 64, for example, projects through the opening 52. At this time, the flange 66 may be welded into its position as shown in FIG. 9 and the flange 68 also welded to the drum shell 20.

Thanks to the configuration of the pockets 42, for example, these pockets may be easily inserted into their working positions in the drum shell 20 and removed therefrom, when necessary. Moreover, the drum shell 20 is not required to have substantial elongated openings extending over a significant portion of the circumference of the shell since only an opening large enough to slide the pocket into its working position is required at one point and a significantly smaller opening, spaced substantially from the large opening, is required for protrusion of the drainpipe on the opposite side of the pocket. In this way, the strength of the drum shell itself is not compromised by the need to provide large openings in the shell at each end of the pocket members or around a major part of the circumference of the pocket members.

The overall construction and operation of the coke cooling apparatus 16 is believed to be within the purview of the artworker from the above description. Although a preferred embodiment of the invention has been described in detail herein those skilled in the art will also recognize that certain modifications and substitutions may be made to the invention without departing from the scope and spirit of the appended claims.

What is claimed is:

1. A coke cooling apparatus comprising an elongated rotatable drum having a circumferential wall forming a hollow drum shell and a plurality of axially and circumferentially spaced cooling pockets supported inside said drum shell for cooling coke in said drum shell and for augering said coke through said drum shell, each of said cooling pockets comprising an elongated tubular member having opposed, planar sidewalls, an end cap secured to said sidewalls at one end, the other end of said cooling pocket being open and a drain conduit formed at said one end, said cooling pocket being insertable in a first opening formed in said drum shell and including a flange for securing said cooling pocket to said drum shell, said drum shell including a smaller second opening formed opposite said first opening for receiving said drain conduit.

2. The apparatus set forth in claim 1 wherein:

said cooling pocket is secured to said drum shell at said flange by welding said flange to said drum shell.

3. The apparatus set forth in claim 1 wherein:

said cooling pocket is secured to said drum shell by a flange disposed around said drain conduit and engageable with said drum shell.

4. The apparatus set forth in claim 3 wherein:

said drum shell is formed of a plurality of plates which are folded to form a drum shell having a polygonal cross section, said plates being welded together to form said drum shell.

5. The apparatus set forth in claim 4 wherein:

each of said plates is formed as a planar plate member having a first opening and a second opening formed spaced apart therein on opposite sides of a portion of said plate which is delimited by fold lines forming planar portions of said drum shell.

6. The apparatus set forth in claim 1 wherein:

said cooling pocket is formed of two opposed plate members, said plate members being folded to form opposed edges which are welded together along said opposed edges.

7. The apparatus set forth in claim 1 wherein:

said drum shell includes spaced apart locating plates secured on interior surfaces of said drum shell for locating said cooling pockets in said drum shell.

8. A cooling pocket for a rotary coke cooling drum for collecting and holding a quantity of cooling water as said cooling drum rotates through a cooling water bath, said cooling pocket comprising:

a generally tubular body formed of two opposed plate members secured to each other along cooperable mating edges and configured for mating insertion into an opening formed in said rotary cake cooling drum an end cap at a first end of said cooling pocket secured to said opposed plate members and closing said first end of said cooling pocket, a second end of said cooling pocket being substantially open between said plate members; and a drain conduit secured to said first end of said cooling pocket.

9. The cooling pocket set forth in claim 8 wherein:

said plate members are each folded at portions adjacent said edges, respectively, to form an interior space between said plate members for receiving coolant.

10. The cooling pocket set forth in claim 8 including:

a corrosion and abrasion resistant cladding disposed on an exterior surface of said cooling pocket.

11. The cooling pocket set forth in claim 8 including:

a generally circumferential flange secured to said plate members at said second end for locating said cooling pocket in said opening formed in said rotary coke cooling drum shell, said flange being operable to secure said cooling pocket in said rotary coke cooling drum shell at said opening.

12. A cooling drum for petroleum coke comprising:

An elongated rotatable drum shell comprising at least two opposed plate members, each of said plate members being folded along spaced apart fold lines, said plate members being welded to each other at cooperating edges to form said shell to have a polygonal cross section, each of said plate members having a set of first spaced apart generally elongated openings disposed between two fold lines and a set of second openings being smaller than said first openings and spaced from said first openings opposite at least one fold line, said openings being adapted to receive elongated tubular cooling pockets within said drum shell, said cooling pockets being arranged axially and circumferentially spaced apart for contact with coke discharged into the interior of said drum shell for cooling said coke and for augering said coke substantially longitudinally through said drum shell during rotation of said drum.

13. The cooling drum set forth in claim 12 wherein:

each of said cooling pockets includes a flange and wherein said cooling pockets are secured to said drum shell at said flanges by welding said flanges to said drum shell.

14. The cooling drum set forth in claim 12 wherein:

said cooling pockets are each secured to said drum shell by a flange disposed around a drain conduit formed on said cooling pocket, and engageable with said drum shell.

15. The cooling drum set forth in claim 12 wherein:

said cooling pockets are formed of two opposed pocket plate members, said pocket plate members being folded to form opposed edges which are welded together to form a tubular pocket member along said opposed edges.

16. The cooling drum set forth in claim 12 wherein:

said drum shell includes spaced apart locating plates secured on interior surfaces of said drum shell for locating said cooling pockets in said drum shell.

* * * * *